US011049453B2

(12) United States Patent
Weng et al.

(10) Patent No.: US 11,049,453 B2
(45) Date of Patent: Jun. 29, 2021

(54) PIXEL CIRCUIT, DRIVING METHOD AND DISPLAY APPARATUS

(71) Applicants: Fuzhou BOE Optoelectronics Technology Co., Ltd., Fujian (CN); BOE Technology Group Co., Ltd., Beijing (CN)

(72) Inventors: Zuwei Weng, Beijing (CN); Yupeng Huang, Beijing (CN); Weize Xu, Beijing (CN); Han Wu, Beijing (CN)

(73) Assignees: Fuzhou BOE Optoelectronics Technology Co., Ltd., Fujian (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/936,577

(22) Filed: Jul. 23, 2020

(65) Prior Publication Data

US 2021/0097934 A1 Apr. 1, 2021

(30) Foreign Application Priority Data

Sep. 29, 2019 (CN) ..... 201910937148.0

(51) Int. Cl.
*G09G 3/3233* (2016.01)

(52) U.S. Cl.
CPC ... *G09G 3/3233* (2013.01); *G09G 2300/0426* (2013.01); *G09G 2320/0233* (2013.01)

(58) Field of Classification Search
CPC ..... G09G 3/3233; G09G 2300/0426; G09G 2320/0233
See application file for complete search history.

(56) References Cited

U.S. PATENT DOCUMENTS 10,672,345 B2 * 6/2020 Xiang ..... G09G 3/3233
2015/0154906 A1 * 6/2015 Chung ..... G09G 3/3291 345/212

* cited by examiner

*Primary Examiner* — Stacy Khoo
(74) *Attorney, Agent, or Firm* — Arent Fox LLP; Michael Fainberg

(57) ABSTRACT

A pixel circuit, a driving method and a display apparatus are provided. The pixel circuit includes: a signal input sub-circuit, a data input sub-circuit, a light emitting control sub-circuit, a compensation sub-circuit, a capacitor sub-circuit, a driving transistor and a light emitting device. By the cooperation of the above sub-circuits and elements, a threshold voltage of the driving transistor can be compensated, and a voltage of a first power terminal can also be compensated.

11 Claims, 6 Drawing Sheets

PIXEL CIRCUIT, DRIVING METHOD AND DISPLAY APPARATUS

CROSS-REFERENCES TO RELATED APPLICATION

This application claims priority to Chinese patent application No. 201910937148.0 filed on Sep. 29, 2019, which is incorporated herein by reference in its entirety.

FIELD

The disclosure relates to the technical field of display, and particularly to a pixel circuit, a driving method and a display apparatus.

BACKGROUND

An Organic Light Emitting Diode (OLED) panel has the characteristics of bendability, high contrast, low power consumption and the like, and has attracted great attention. The pixel circuit is the key technical content of the OLED panel, and has the important research significance. Generally, the OLED in the OLED panel is driven to emit light by a current generated by a driving transistor in the pixel circuit. However, due to limitation of a process and increase of use time, a threshold voltage Vth of the driving transistor may drift in varying degrees, resulting in that the OLED panel has a problem of uneven light emitting brightness. In addition, due to IR Drop (voltage drop) in the OLED panel, the OLED panel may also have the problem of uneven light emitting brightness.

SUMMARY

In one aspect, an embodiment of the disclosure provides a pixel circuit. The pixel circuit includes: a signal input sub-circuit, a data input sub-circuit, a light emitting control sub-circuit, a compensation sub-circuit, a capacitor sub-circuit, a driving transistor and a light emitting device. The signal input sub-circuit is configured to provide a signal of a reference voltage signal terminal to a gate of the driving transistor under a control of a signal of a first scanning signal terminal; the data input sub-circuit is configured to provide a signal of a data signal terminal to an intermediate node under the control of a signal of a second scanning signal terminal; the compensation sub-circuit is configured to electrically connect the gate of the driving transistor to the intermediate node under the control of a signal of a first control signal terminal; the capacitor sub-circuit is configured to adjust a potential of a second electrode of the driving transistor according to a signal of a second control signal terminal, and adjust a potential of the intermediate node according to the potential of the second electrode of the driving transistor; the light emitting control sub-circuit is configured to electrically connect a first electrode of the light emitting device to the second electrode of the driving transistor under the control of a signal of a light emitting control signal terminal, to drive the light emitting device to emit light; and a first electrode of the driving transistor is electrically connected with a first power terminal.

In some embodiments, the signal input sub-circuit includes a first switching transistor. The first switching transistor has a first electrode electrically connected with the reference voltage signal terminal, a gate electrically connected with the first scanning signal terminal, and a second electrode electrically connected with the gate of the driving transistor.

In some embodiments, the data input sub-circuit includes a second switching transistor. The second switching transistor has a first electrode electrically connected with the data signal terminal, a gate electrically connected with the second scanning signal terminal, and a second electrode electrically connected with the intermediate node.

In some embodiments, the compensation sub-circuit includes a third switching transistor. The third switching transistor has a first electrode electrically connected with the gate of the driving transistor, a gate electrically connected with the first control signal terminal, and a second electrode electrically connected with the intermediate node.

In some embodiments, the light emitting control sub-circuit includes a fourth switching transistor. The fourth switch transistor has a first electrode electrically connected with the second electrode of the driving transistor, a gate electrically connected with the light emitting control signal terminal, and a second electrode electrically connected with the first electrode of the light emitting device.

In some embodiments, the capacitor sub-circuit includes a first capacitor and a second capacitor. The first capacitor has a first terminal electrically connected with the intermediate node, and a second terminal electrically connected with the second electrode of the driving transistor; and the second capacitor has a first terminal electrically connected with the second electrode of the driving transistor, and a second terminal electrically connected with the second control signal terminal.

In some embodiments, the first scanning signal terminal and the second scanning signal terminal are the same terminal, and/or, the first control signal terminal and the light emitting control signal terminal are the same terminal.

In some embodiments, a voltage of the signal of the reference voltage signal terminal is smaller than a voltage of the signal of the data signal terminal, and a difference between the voltage of the signal of the reference voltage signal terminal and a voltage of the first electrode of the light emitting device is greater than a threshold voltage of the driving transistor when the light emitting device emits light.

In another aspect, an embodiment of the disclosure further provides a display apparatus, including any pixel circuit according to the embodiment of the disclosure.

In another aspect, an embodiment of the disclosure further provides a driving method of the pixel circuit. The driving method includes: in a data input stage, loading a first level to a first scanning signal terminal, loading the first level signal to a second scanning signal terminal, loading a second level signal to a first control signal terminal, loading the second level signal to a light emitting control signal terminal, and loading a first potential signal to a second control signal terminal; in a compensation stage, loading the second level signal to the first scanning signal terminal, loading the second level signal to the second scanning signal terminal, loading the second level signal to the first control signal terminal, loading the second level signal to the light emitting control signal terminal, and loading a second potential signal to the second control signal terminal; and in a light emitting stage, loading the second level signal to the first scanning signal terminal, loading the second level signal to the second scanning signal terminal, loading the first level signal to the first control signal terminal, loading the first level signal to the light emitting control signal terminal, and loading the second potential signal to the second control signal terminal.

In some embodiments, the first level signal and the second level signal are opposite level signals.

DETAILED DESCRIPTION

In order to make objects, technical solutions and advantages of the embodiments of the disclosure clearer, the technical solutions of the embodiments of the disclosure will be described clearly and completely in combination with accompanying drawings. Obviously, the described embodiments are just a part but not all of the embodiments of the disclosure. In case of no conflict, the embodiments of the disclosure and the features in the embodiments can be combined with each other. Based on the described embodiments of the disclosure, other embodiments obtained by those of ordinary skill in the art without any inventive work fall within the scope of the disclosure.

Unless otherwise defined, the technical terms or scientific terms used herein should be of general meaning as understood by those of ordinarily skill in the art. In the disclosure, words such as "first" and "second" do not denote any order, quantity, or importance, but are only used for distinguishing different components. Words such as "include" or "comprise" denote that elements or objects appearing before the words cover the elements or the objects enumerated after the words and equivalents thereof, not exclusive of other elements or objects. Words such as "connected" or "connecting" are not limited to physical or mechanical connections, but may include electrical connection, whether direct or indirect.

It should be noted that the size and shape of each figure in the accompanying drawings do not reflect a true scale, and are just used for schematically illustrating the contents of the disclosure. Moreover, the same or similar signs throughout represent the same or similar elements or elements with the same or similar functions.

Embodiments of the disclosure provide a pixel circuit, a driving method and a display apparatus, to address a problem of uneven light emitting brightness in the display apparatus and address a problem of high requirement for accuracy of a data voltage output by a driving circuit.

Figure 1:
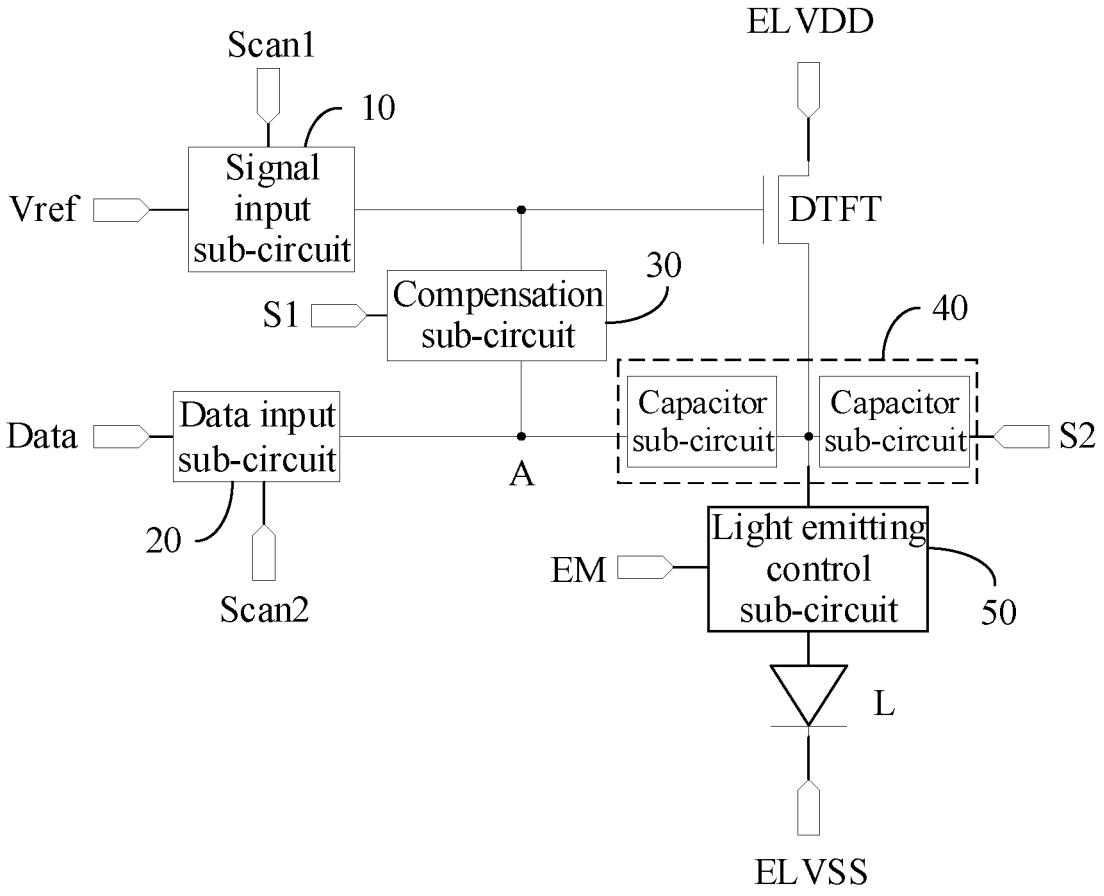
FIG. 1 is a schematic structural diagram of a pixel circuit according to an embodiment of the disclosure.

An embodiment of the disclosure provides a pixel circuit. As shown in FIG. 1, the pixel circuit includes: a signal input sub-circuit 10, a data input sub-circuit 20, a light emitting control sub-circuit 50, a compensation sub-circuit 30, a capacitor sub-circuit 40, a driving transistor DTFT and a light emitting device L.

The signal input sub-circuit 10 is configured to provide a signal of a reference voltage signal terminal Vref to a gate of the driving transistor DTFT under the control of a signal of a first scanning signal terminal Scan1.

The data input sub-circuit 20 is configured to provide a signal of a data signal terminal Data to an intermediate node A under the control of a signal of a second scanning signal terminal Scan2.

The compensation sub-circuit 30 is configured to electrically connect the gate of the driving transistor DTFT to the intermediate node A under the control of a signal of a first control signal terminal S1.

The capacitor sub-circuit 40 is configured to adjust a potential of a second electrode of the driving transistor DTFT according to a signal of a second control signal terminal S2, and adjust a potential of the intermediate node A according to the potential of the second electrode of the driving transistor DTFT.

The light emitting control sub-circuit 50 is configured to electrically connect a first electrode of the light emitting device L to the second electrode of the driving transistor DTFT under the control of a signal of a light emitting control signal terminal EM so as to drive the light emitting device L to emit light. The first electrode of the driving transistor DTFT is electrically connected with a first power terminal ELVDD.

In the pixel circuit according to the embodiment of the disclosure, the above sub-circuits and elements are cooperated, a threshold voltage Vth of the driving transistor DTFT can be compensated, so that a driving current for driving the light emitting device L to emit light is not influenced by the threshold voltage Vth of the driving transistor DTFT, and a problem of uneven light emitting brightness caused by the uneven threshold voltage Vth is improved. Moreover, the above sub-circuits and elements are cooperated, a voltage of the first power terminal ELVDD can be compensated, so that the driving current is not influenced by IR Drop of the first power terminal ELVDD, and a problem of uneven light emitting brightness caused by the IR Drop of the first power terminal ELVDD can be improved. Furthermore, a problem of high requirement for accuracy of a data voltage of a data input terminal can also be improved.

Figure 2:
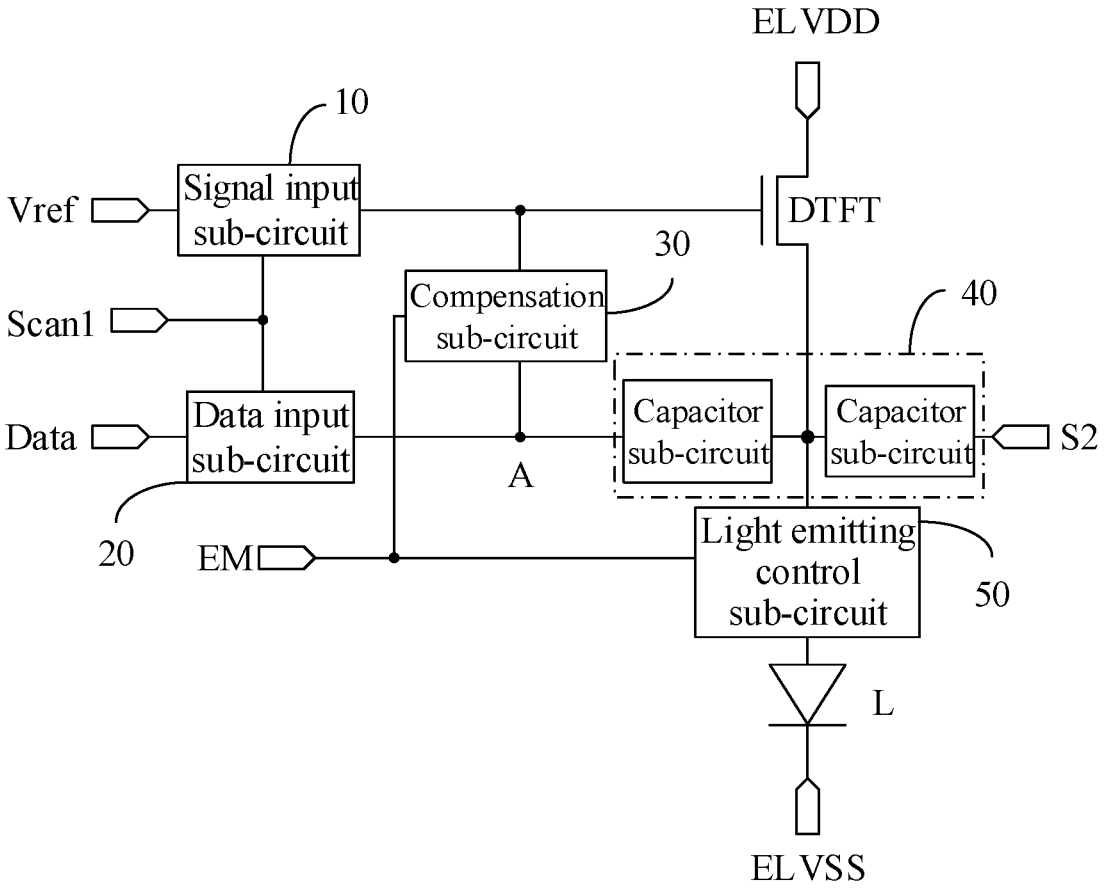
FIG. 2 is a schematic structural diagram of another pixel circuit according to an embodiment of the disclosure.

In some embodiments, in the pixel circuit, as shown in FIG. 2, the first scanning signal terminal Scan1 and the second scanning signal terminal Scan2 may be the same terminal. Therefore, the number of the signal terminals can be reduced, complexity can be lowered, and an occupied space of signal lines can be reduced.

In some embodiments, in the pixel circuit, as shown in FIG. 2, the first control signal terminal S1 and the light emitting control signal terminal EM may be the same terminal. Therefore, the number of the signal terminals can be reduced, complexity can be lowered, and the occupied space of the signal lines can be reduced.

In some embodiments, in the pixel circuit, as shown in FIG. 1 and FIG. 2, the driving transistor DTFT may be an N-type transistor. Of course, the driving transistor DTFT may be a P-type transistor, and the design principle of the driving transistor DTFT being P-type transistor is the same as that of the disclosure, and also falls within the scope of the disclosure.

In some embodiments, in the pixel circuit, a first electrode of the light emitting device L is electrically connected with the light emitting control sub-circuit 50, and a second electrode of the light emitting device L is electrically connected with a second power terminal ELVSS. Moreover, in the implementation, the light emitting device L may be at least one of an Organic Light Emitting Diode (OLED) and Quantum Dot Light Emitting Diodes (QLED). For example, when the light emitting device L is the OLED, a positive electrode of the OLED is the first electrode of the light emitting device L, and a negative electrode of the OLED is the second electrode of the light emitting device L.

Figure 3:
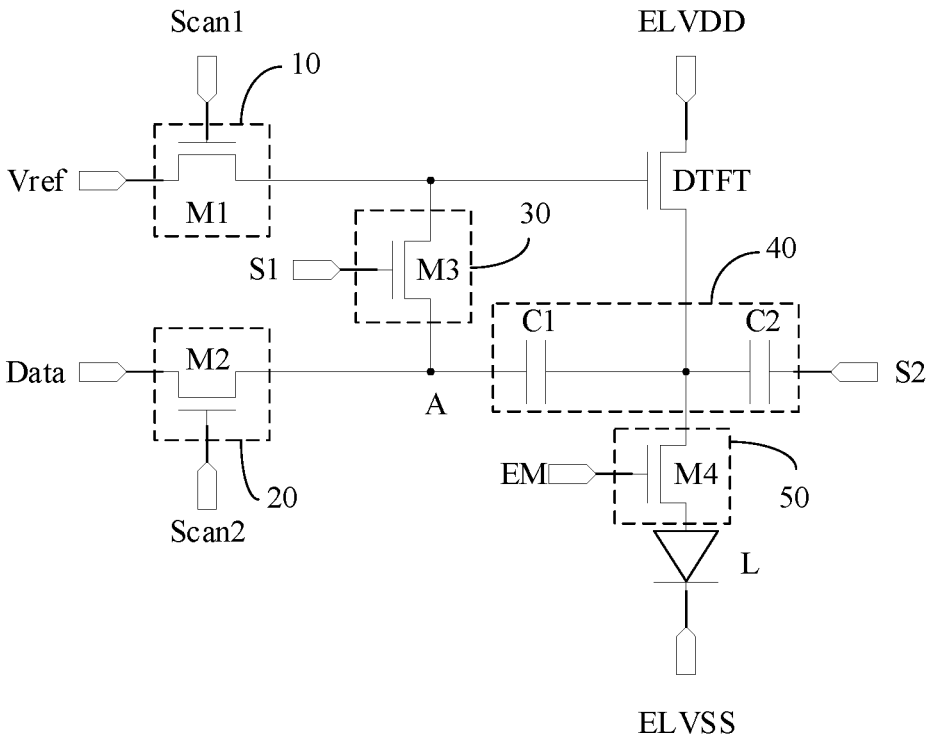
FIG. 3 is a schematic circuit diagram of a pixel circuit according to an embodiment of the disclosure.

In some embodiments, in a pixel circuit, as shown in FIG. 3, the signal input sub-circuit 10 includes a first switching transistor M1, a first electrode of the first switching transistor M1 is electrically connected with the reference voltage signal terminal Vref, a gate of the first switching transistor M1 is electrically connected with the first scanning signal terminal Scan1, and a second electrode of the first switching transistor M1 is electrically connected with the gate of the driving transistor DTFT.

In an implementation, the first switching transistor M1 is turned on under the control of the first scanning signal terminal Scan1, to provide a signal VREF of the reference voltage signal terminal Vref to the gate of the driving transistor DTFT.

In some embodiments, in the pixel circuit, as shown in FIG. 3, the data input sub-circuit 20 includes a second switching transistor M2, a first electrode of the second switching transistor M2 is electrically connected with the data signal terminal Data, a gate of the second switching transistor M2 is electrically connected with the second scanning signal terminal Scan2, and a second electrode of the second switching transistor M2 is electrically connected with the intermediate node A.

In an implementation, the second switching transistor M2 is turned on under the control of the second scanning signal terminal Scan2, to provide a signal Vdata of the data signal terminal Data to the intermediate node A.

In some embodiments, in the pixel circuit, as shown in FIG. 3, the compensation sub-circuit 30 includes a third switching transistor M3, a first electrode of the third switching transistor M3 is electrically connected with the gate of the driving transistor DTFT, a gate of the third switching transistor M3 is electrically connected with the first control signal terminal S1, and a second electrode of the third switching transistor M3 is electrically connected with the intermediate node A.

In the implementation, the third switching transistor M3 is turned on under the control of the first control signal terminal S1, to electrically connect the gate of the driving transistor DTFT to the intermediate node A.

In some embodiments, in the pixel circuit, as shown in FIG. 3, the light emitting control sub-circuit 50 includes a fourth switching transistor M4, a first electrode of the fourth switching transistor M4 is electrically connected with the second electrode of the driving transistor DTFT, a gate of the fourth switching transistor M4 is electrically connected with the light emitting control signal terminal EM, and a second electrode of the fourth switching transistor M4 is electrically connected with the first electrode of the light emitting device L.

In the implementation, the fourth switching transistor M4 electrically connects the first electrode of the light emitting device L to a second electrode of the driving transistor DTFT under the control of the light emitting control signal terminal EM, so as to drive the light emitting device L to emit light.

In some embodiments, in the pixel circuit, as shown in FIG. 3, the capacitor sub-circuit 40 includes a first capacitor C1 and a second capacitor C2. A first terminal of the first capacitor C1 is electrically connected with the intermediate node A, and a second terminal of the first capacitor C1 is electrically connected with the second electrode of the driving transistor DTFT. A first terminal of the second capacitor C2 is electrically connected with the second electrode of the driving transistor DTFT, and a second terminal of the second capacitor C2 is electrically connected with the second control signal terminal S2.

In the implementation, the first capacitor C1 and the second capacitor C2 maintain charge conservation, and when the signal of the second control signal terminal S2 is changed, the second capacitor C2 adjusts a potential of the second electrode of the driving transistor DTFT according to the signal of the second control signal terminal S2. When the potential of the second electrode of the driving transistor DTFT is changed, the first capacitor C1 adjusts a potential of the intermediate node A according to the potential of the second electrode of the driving transistor DTFT.

Figure 4:
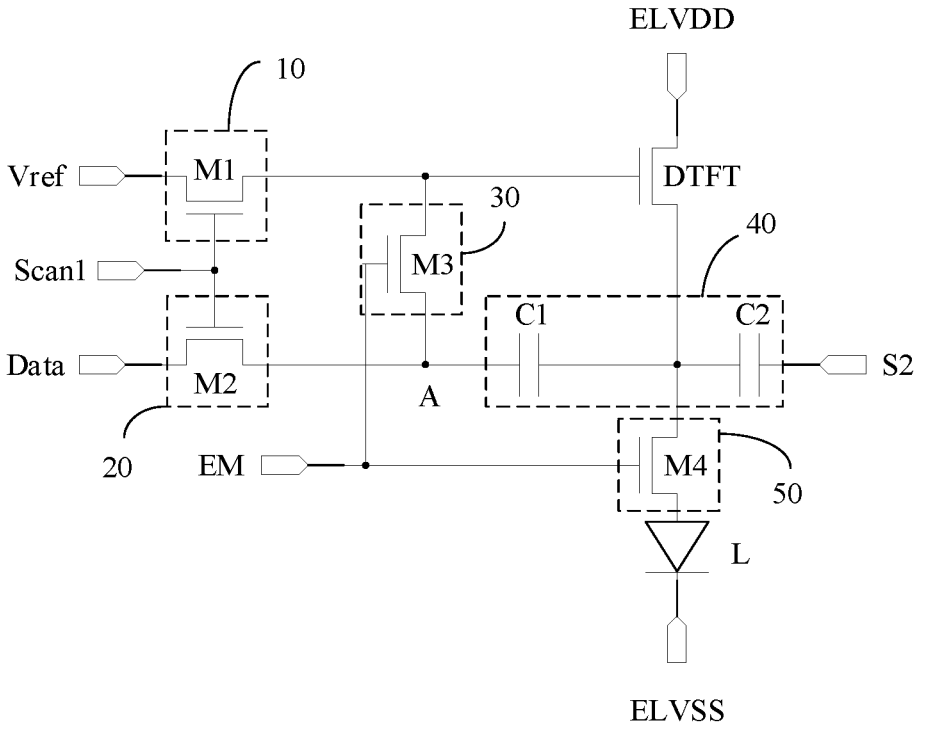
FIG. 4 is a schematic circuit diagram of another pixel circuit according to an embodiment of the disclosure.

In some embodiments, in the pixel circuit, as shown in FIG. 4, the first scanning signal terminal Scan1 and the second scanning signal terminal Scan2 may be the same terminal. Therefore, the number of the signal terminals can be reduced, complexity can be lowered, and the occupied space of the signal lines can be reduced.

In some embodiments, in the pixel circuit, as shown in FIG. 4, the first control signal terminal S1 and the light emitting control signal terminal EM may be the same terminal. Therefore, the number of the signal terminals can be reduced, complexity can be lowered, and the occupied space of the signal lines can be reduced.

In some embodiments, in the pixel circuit, a voltage VREF of a signal of the reference voltage signal terminal Vref is smaller than a voltage Vdata of a signal of the data signal terminal Data, and a difference between the voltage VREF of the signal of the reference voltage signal terminal Vref and a voltage Vanode of a first electrode of the light emitting device L when the light emitting device L emits light is greater than a threshold voltage Vth of the driving transistor DTFT, that is, VREF<Vdata, and VREF−Vanode>Vth. Of course, a specific voltage value of the above voltage may be designed and determined according to a practical application environment, and is not limited herein.

The above merely illustrates the specific structure of each sub-circuit in the pixel circuit according to the embodiments of the disclosure, and in the implementation, the specific structures of the above sub-circuits are not limited to the structures provided by the embodiments of the disclosure, may also be other structures known to those skilled in the art, and are not limited herein.

In some embodiments, in order to achieve uniformity of a production process, in the pixel circuit according to the disclosure, as shown in FIG. 3 and FIG. 4, all the switching transistors may be N-type transistors. Of course, all the switching transistors may also be P-type transistors, and are not limited herein.

Specifically, in the pixel circuit according to the embodiment of the disclosure, the P-type transistors are turned on under a low-level signal, and turned off under a high-level signal; and the N-type transistors are turned on under a high-level signal, and turned off under a low-level signal.

In some embodiments, in the pixel circuit, the above switching transistors may be Thin Film Transistors (TFT), or may be Metal Oxide Semiconductor (MOS) field-effect transistors, and are not limited herein. Moreover, according to different types of the above switching transistors and different signals of the gates of the switching transistors, the first electrode of the switching transistor can be used as a source, and the second electrode of the switching transistor can be used as a drain; or the first electrode of the switching transistor is used as the drain, while the second electrode of the switching transistor is used as the source, which are not distinguished herein.

The disclosure will be described in detail below in combination with specific embodiments. It should be noted that the embodiments are used for explaining the disclosure better, but not intended to limit the disclosure.

The working process of the pixel circuit according to the embodiments of the disclosure will be described below in combination with the timing diagram of the circuit. In the description below, 1 represents a high potential, and 0 represents a low potential. It should be noted that 1 and 0 represent logic potentials, and are merely used for explaining the working processes of the embodiments of the disclosure better, but are not specific voltage values.

Figure 5:
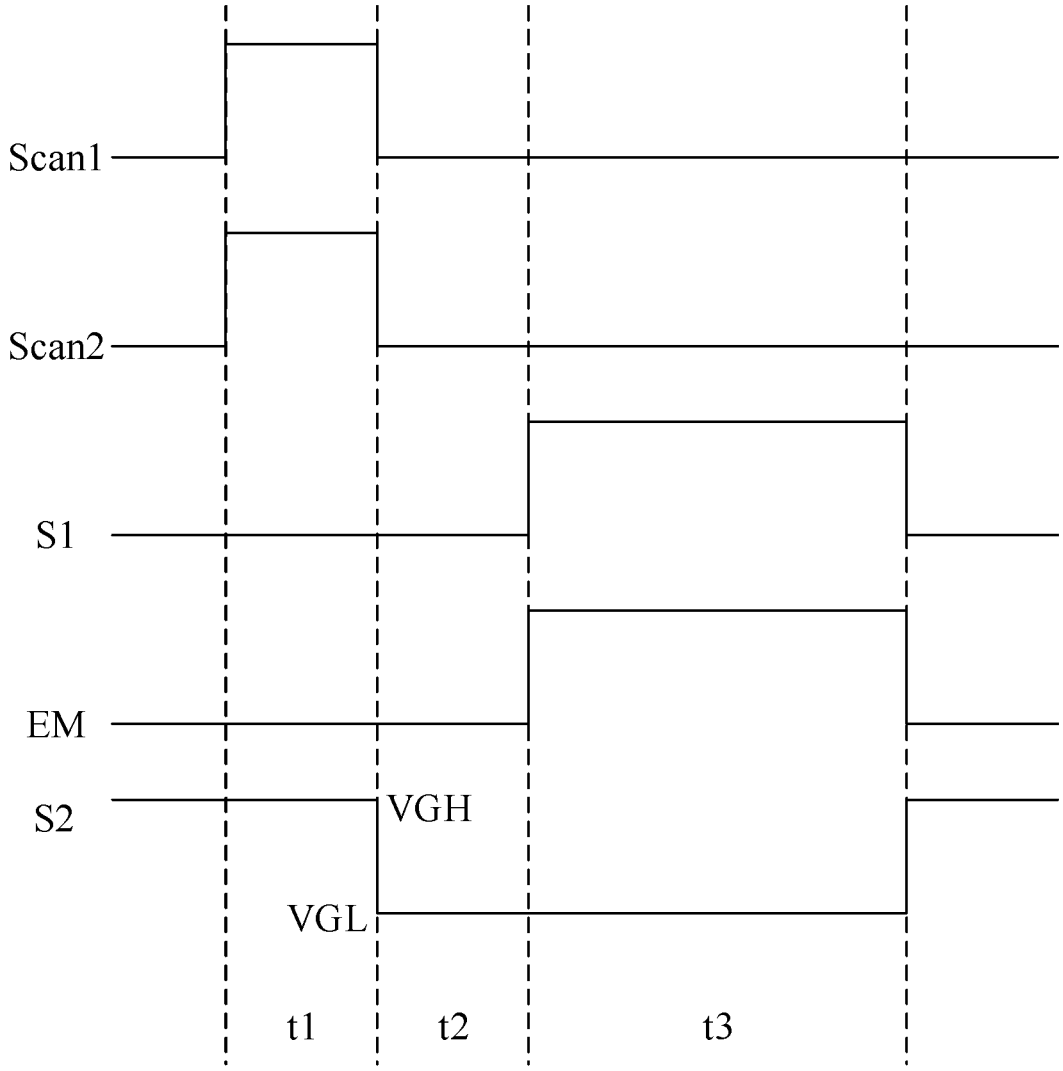
FIG. 5 is a timing diagram of the pixel circuit in FIG. 3.

In one or more embodiments, by taking the pixel circuit shown in FIG. 3 as an example below, the working process of the pixel circuit according to the embodiment of the disclosure will be described below in combination with the timing diagram of a circuit signal, as shown in FIG. 5. Specifically, three stages, i.e., a data input stage t1, a compensation stage t2 and a light emitting stage t3, in the input timing diagram as shown in FIG. 5 are selected. Assume that the potential of the second electrode of the driving transistor DTFT is Vs.

In the data input stage t1, Scan1=1, Scan2=1, S1=0, EM=0, and S2=1.

Scan1=1, the first switching transistor M1 is turned on; Scan2=1, the second switching transistor M2 is turned on; S1=0, the third switching transistor M3 is turned off; EM=0, the fourth switching transistor M4 is turned off; and S2=1, at the moment, a voltage of S2 is VGH, and thus, a voltage of the second terminal of the second capacitor C2 is VGH.

Therefore, the voltage VREF of the signal of the reference voltage signal terminal Vref is transmitted to the gate of the driving transistor DTFT through the first switching transistor M1, the second electrode of the driving transistor DTFT still maintains the potential Vanode of the first electrode of the light emitting device L when the light emitting device L emits light in a previous frame, and Vs=Vanode. Due to VREF>Vanode+Vth, a voltage difference between the gate and the second electrode of the driving transistor DTFT is Vgs=Vg−Vanode=VREF−Vanode, and the driving transistor DTFT is turned on. The driving transistor DTFT is turned off until the potential of the second electrode of the driving transistor DTFT is VREF-Vth and the voltage difference between the gate and the second electrode of the driving transistor DTFT is Vth. The voltage Vdata of the signal of the data signal terminal Data is written into the intermediate node A through the second switching transistor M2, and then a voltage of the intermediate node A is the voltage Vdata of the signal of the data signal terminal Data.

In the compensation stage t2, Scan1=0, Scan2=0, S1=0, EM=0, and S2=0.

Scan1=0, the first switching transistor M1 is turned off; Scan2=0, the second switching transistor M2 is turned off; S1=0, the third switching transistor M3 is turned off; EM=0, the fourth switching transistor M4 is turned off; and S2=0, at the moment, the voltage of S2 is VGL, and the voltage of the second terminal of the second capacitor C2 is changed into VGL from VGH.

The potential of the intermediate node A is Vdata, the potential of the second electrode of the driving transistor DTFT is VREF-Vth when the compensation stage t2 is started. The first capacitor C1 and the second capacitor C2 maintain charge conservation, so that the second capacitor C2 adjusts the potential Vs of the second electrode of the driving transistor DTFT according to a signal change of the second control signal terminal S2. Specifically, according to charge conservation, it can be obtained that:

$$C1(VREF-Vth-Vdata)+C2(VREF-Vth-VGH)=C1(Vs-Vdata)+C2(Vs-VGL);$$

at the moment, the potential Vs of the second electrode of the driving transistor DTFT is Vs=VREF−Vth−[C2/(C1+C2)](VGH−VGL).

In the light emitting stage t3, Scan1=0, Scan2=0, S1=1, EM=1, and S2=0.

Scan1=0, the first switching transistor M1 is turned off; Scan2=0, the second switching transistor M2 is turned off; S1=1, the third switching transistor M3 is turned on; EM=1, the fourth switching transistor M4 is turned on; and S2=0, the voltage of S2 is maintained as VGL, and thus, the potential of the second terminal of the second capacitor C2 is unchanged.

Due to that the fourth switching transistor M4 is turned on, the potential of the first electrode of the light emitting device L changes the potential of the second electrode of the driving transistor DTFT, and at the moment, the potential Vs of the second electrode of the driving transistor DTFT is Vs=Voled.

When the light emitting stage t3 is started, the potential of the second electrode of the driving transistor DTFT is VREF−Vth−[C2/(C1+C2)](VGH−VGL); and when the light emitting stage t3 is started, the potential of the intermediate node A is Vdata, the first capacitor C1 maintains charge conservation, and thus, the first capacitor adjusts the potential of the intermediate node A according to a change of the potential of the second electrode of the driving transistor DTFT, and at the moment, the potential of the intermediate node A is Vdata−VREF+Vth+[C2/(C1+C2)](VGH−VGL)+Voled.

Due to that the third switching transistor M3 is turned on, the potential of the intermediate node A is transmitted to the gate of the driving transistor DTFT, the voltage difference between the gate and the second electrode of the driving transistor DTFT is: Vgs=Vdata−VREF+Vth+[C2/(C1+C2)](VGH−VGL).

A formula of a driving current I is that:

$$I=K(Vgs-Vth)^2=K\{Vdata-VREF+[C2/(C1+C2)](VGH-VGL)\}^2;$$

where $$K=\frac{1}{2}\mu_n C_{ox}\frac{W}{L},$$

$\mu_n$ represents mobility of the driving transistor DTFT, $C_{ox}$ represents a gate oxide capacitance in unit area, $$\frac{W}{L}$$

represents a width-to-length ratio of the driving transistor DTFT, and in the same structure, these values are relatively stable and can be regarded as constants.

It can be seen from the above formula that in this way the driving current I output by the driving transistor DTFT is not influenced by the threshold voltage Vth of the driving transistor DTFT and voltage drop of a first voltage source ELVDD, so that problems of drift of the threshold voltage of the driving transistor DTFT caused by the process and the long-time operation, and the voltage drop of the first voltage source ELVDD are improved, and further, a display effect is improved.

The signal of the reference voltage signal terminal Vref is only used for loading the voltage VREF to the gate of the driving transistor, and thus, when the first switching transistor M1 is turned on, a current passing through the first switching transistor M1 can be regarded as 0, so that voltage drop of the signal of the reference voltage signal terminal Vref is very small and can be ignored.

Moreover, when the voltage of the data signal terminal Data is Vdata, an actual data voltage is Vdata+[C2/(C1+C2)](VGH−VGL), i.e., a magnitude of the actual data voltage can be adjusted by adjusting a magnitude of [C2/(C1+C2)](VGH−VGL), so that a range of the data voltage is expanded, and the requirement for voltage accuracy of a driving circuit generating the data voltage is reduced.

Figure 6:
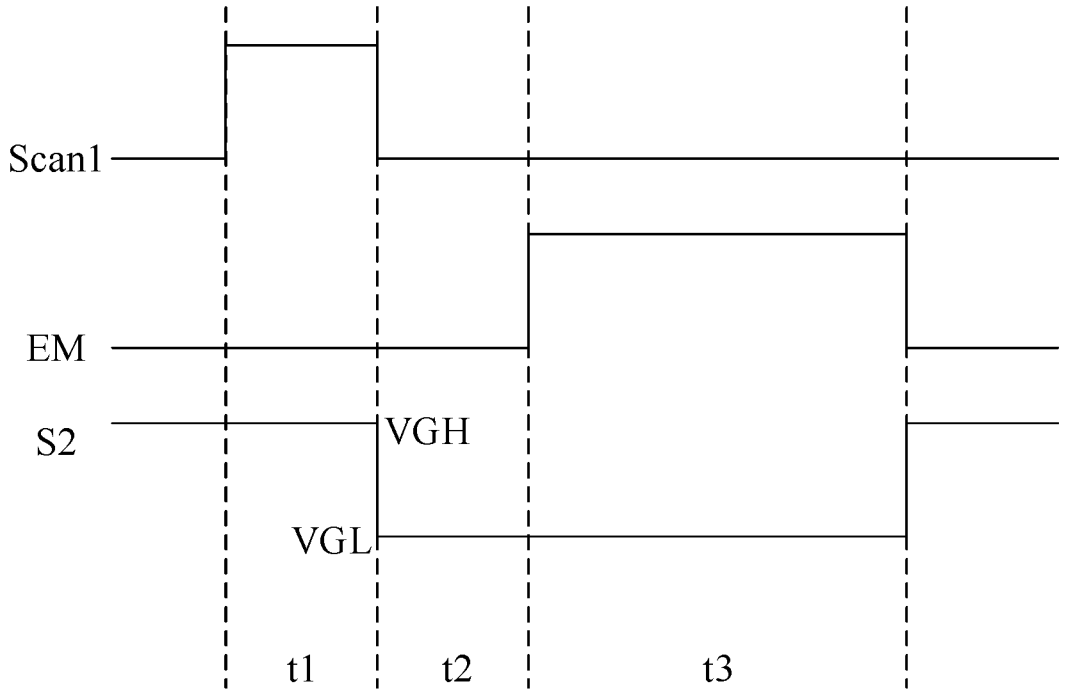
FIG. 6 is a timing diagram of the pixel circuit in FIG. 4.

In one or more embodiments, by taking the pixel circuit shown in FIG. 4 as an example below, the working process of the above pixel circuit according to the embodiment of the disclosure will be described in combination with the timing diagram of a circuit signal, as shown in FIG. 6. Specifically, three stages, i.e., a data input stage t1, a compensation stage t2 and a light emitting stage t3, in the timing diagram of the circuit signal, as shown in FIG. 6, are selected.

In the data input stage t1, Scan1=1, S1=0, and S2=1.

The working process in this stage may be basically the same as the working process in the stage t1 in Embodiment I, and is not repeated herein.

In the compensation stage t2, Scan1=0, S1=0, and S2=0.

The working process in this stage may be basically the same as the working process in the stage t2 in Embodiment I, and is not repeated herein.

In the light emitting stage t3, Scan1=0, S1=1, and S2=0.

The working process in this stage may be basically the same as the working process in the stage t3 in Embodiment I, and is not repeated herein.

Figure 7:
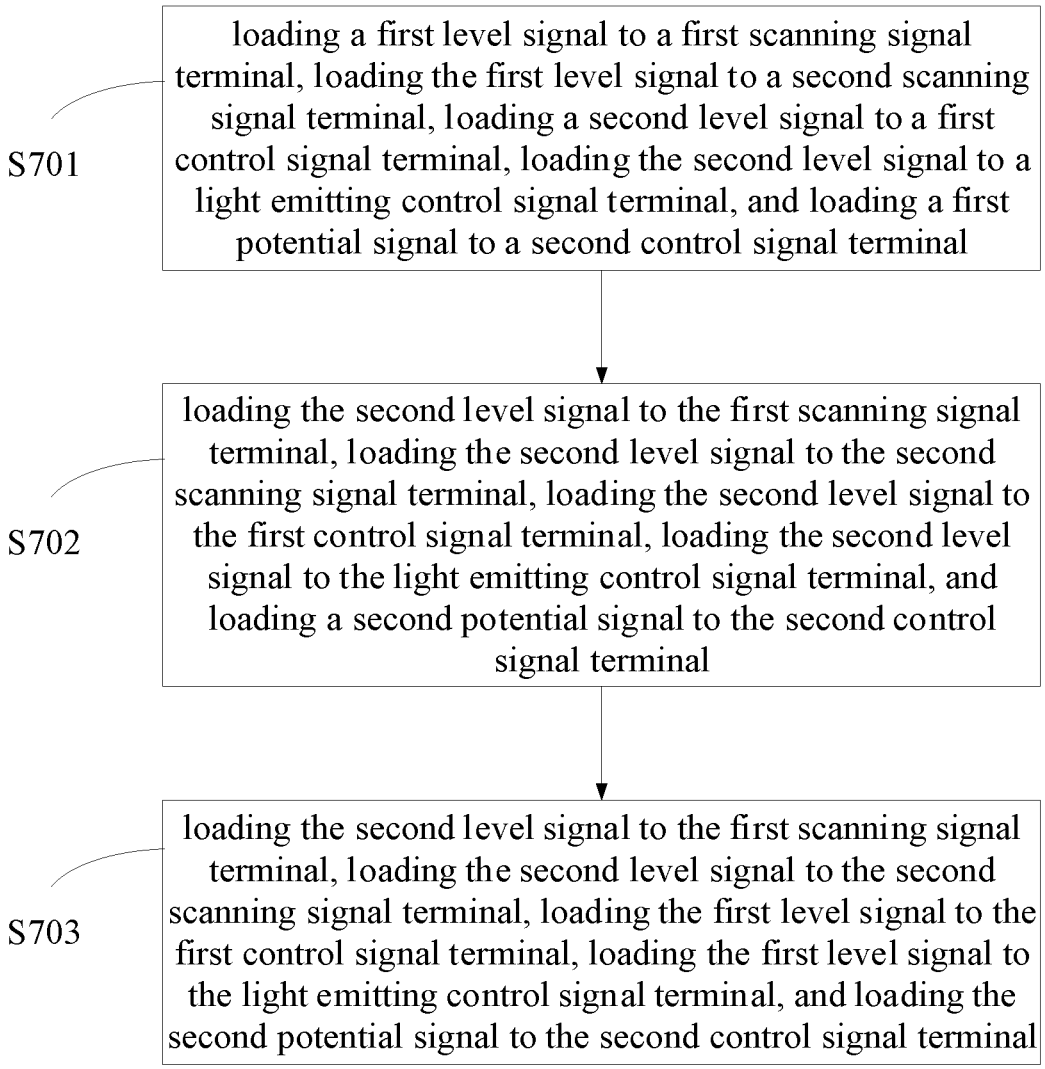
FIG. 7 is a flow chart of a driving method according to an embodiment of the disclosure.

Based on the same inventive concept, an embodiment of the disclosure further provides a driving method of the pixel circuit, as shown in FIG. 7, including: a data input stage, a compensation stage, and a light emitting stage.

S701: a first level signal is loaded to a first scanning signal terminal, the first level signal is loaded to a second scanning signal terminal, a second level signal is loaded to a first control signal terminal, the second level signal is loaded to a light emitting control signal terminal, and a first potential signal is loaded to a second control signal terminal.

S702: the second level signal is loaded to the first scanning signal terminal, the second level signal is loaded to the second scanning signal terminal, the second level signal is loaded to the first control signal terminal, the second level signal is loaded to the light emitting control signal terminal, and a second potential signal is loaded to the second control signal terminal.

S703: the second level signal is loaded to the first scanning signal terminal, the second level signal is loaded to the second scanning signal terminal, the first level signal is loaded to the first control signal terminal, the first level signal is loaded to the light emitting control signal terminal, and the second potential signal is loaded to the second control signal terminal.

In some embodiments, in the driving method of the pixel circuit, as shown in FIG. 5, the first level signal may be a low-level signal, and correspondingly the second level signal is a high-level signal; or conversely, the first level signal may also be a high-level signal, and correspondingly the second level signal is a low-level signal, depending on whether the transistor is an N-type transistor or a P-type transistor, which is not limited here.

The principle and implementation of the driving method of the pixel circuit is the same as those of the pixel circuit above, the driving method may be implemented by referring to the implementation of the pixel circuit in the above embodiment, which will not be repeated here.

According to the driving method provided by the embodiment of the disclosure, a threshold voltage of a driving transistor and IR-Drop of a first power terminal can be compensated by simple timing, and a range of a data voltage can be expanded by setting a first potential signal and a second potential signal.

Based on the same inventive concept, an embodiment of the disclosure further provides a display apparatus. The display apparatus includes the above pixel circuit. Implementation of the display apparatus can refer to the embodiments of the above pixel circuit, and the repeated parts are not described herein.

In the implementation, the display apparatus may be any product or part with a display function, such as a mobile phone, a tablet personal computer, a television, a display, a notebook computer, a digital photo frame and a navigator. Other essential components of the display apparatus should be understood by those of ordinary skill in the art, are not repeated herein and should not be limitative of the disclosure.

According to the pixel circuit, the driving method and the display apparatus, provided by the embodiments of the disclosure, the pixel circuit includes: the signal input sub-circuit, the data input sub-circuit, the light emitting control sub-circuit, the compensation sub-circuit, the capacitor sub-circuit, the driving transistor and the light emitting device. The signal input sub-circuit can provide the signal of the reference voltage signal terminal to the gate of the driving transistor under the control of the signal of the first scanning signal terminal; the data input sub-circuit can provide the signal of the data signal terminal to the intermediate node under the control of the signal of the second scanning signal terminal; the compensation sub-circuit can electrically connect the gate of the driving transistor to the intermediate node A under the control of the signal of the first control signal terminal; the capacitor sub-circuit can adjust the potential of the second electrode of the driving transistor according to the signal of the second control signal terminal, and adjust the potential of the intermediate node A according to the potential of the second electrode of the driving transistor; the light emitting control sub-circuit can electrically connect the first electrode of the light emitting device to the second electrode of the driving transistor under the control of the signal of the light emitting control signal terminal to drive the light emitting device to emit light; and the first electrode of the driving transistor is electrically connected with the first power terminal. By the cooperation of the above sub-circuits and elements, the threshold voltage of the driving transistor can be compensated, so that the driving current for driving the light emitting device L to emit light is not influenced by the threshold voltage of the driving transistor, and the problem of uneven light emitting brightness caused by the uneven threshold voltage is improved. Moreover, by cooperation of the above sub-circuits and elements, the voltage of the first power terminal can be compensated, so that the driving current is not influenced by the voltage of the first power terminal, and the problem of uneven light emitting brightness caused by the IR Drop of the first power terminal can be improved. Furthermore, by cooperation of the above sub-circuits and elements, the range of the data voltage can also be expanded, and the requirement for voltage accuracy of the driving circuit generating the data voltage can be reduced, so that the display effect is greatly improved.

Evidently those skilled in the art can make various modifications and variations to the invention without departing from the spirit and scope of the invention. Thus the invention is also intended to encompass these modifications and variations therein as long as these modifications and variations come into the scope of the claims of the invention and their equivalents.

What is claimed is:

1. A pixel circuit, comprising: a signal input sub-circuit, a data input sub-circuit, a light emitting control sub-circuit, a compensation sub-circuit, a capacitor sub-circuit, a driving transistor and a light emitting device; wherein:

the signal input sub-circuit is configured to provide a signal of a reference voltage signal terminal to a gate of the driving transistor under a control of a signal of a first scanning signal terminal;

the data input sub-circuit is configured to provide a signal of a data signal terminal to an intermediate node under a control of a signal of a second scanning signal terminal;

the compensation sub-circuit is configured to electrically connect the gate of the driving transistor to the intermediate node under a control of a signal of a first control signal terminal;

the capacitor sub-circuit is configured to adjust a potential of a second electrode of the driving transistor according to a signal of a second control signal terminal, and adjust a potential of the intermediate node according to the potential of the second electrode of the driving transistor;

the light emitting control sub-circuit is configured to electrically connect a first electrode of the light emitting device to the second electrode of the driving transistor under a control of a signal of a light emitting control signal terminal, to drive the light emitting device to emit light; and a first electrode of the driving transistor is electrically connected with a first power terminal.

2. The pixel circuit according to claim 1, wherein the signal input sub-circuit comprises a first switching transistor;

wherein the first switching transistor has a first electrode electrically connected with the reference voltage signal terminal, a gate electrically connected with the first scanning signal terminal, and a second electrode electrically connected with the gate of the driving transistor.

3. The pixel circuit according to claim 1, wherein the data input sub-circuit comprises a second switching transistor;

wherein the second switching transistor has a first electrode electrically connected with the data signal terminal, a gate electrically connected with the second scanning signal terminal, and a second electrode electrically connected with the intermediate node.

4. The pixel circuit according to claim 1, wherein the compensation sub-circuit comprises a third switching transistor;

wherein the third switching transistor has a first electrode electrically connected with the gate of the driving transistor, a gate electrically connected with the first control signal terminal, and a second electrode electrically connected with the intermediate node.

5. The pixel circuit according to claim 1, wherein the light emitting control sub-circuit comprises a fourth switching transistor;

wherein the fourth switching transistor has a first electrode electrically connected with the second electrode of the driving transistor, a gate electrically connected with the light emitting control signal terminal, and a second electrode electrically connected with the first electrode of the light emitting device.

6. The pixel circuit according to claim 1, wherein the capacitor sub-circuit comprises a first capacitor and a second capacitor;

wherein the first capacitor has a first terminal electrically connected with the intermediate node, and a second terminal electrically connected with the second electrode of the driving transistor; and the second capacitor has a first terminal electrically connected with the second electrode of the driving transistor, and a second terminal electrically connected with the second control signal terminal.

7. The pixel circuit according to claim 1, wherein the first scanning signal terminal and the second scanning signal terminal are a same terminal, and/or, the first control signal terminal and the light emitting control signal terminal are a same terminal.

8. The pixel circuit according to claim 7, wherein a voltage of the signal of the reference voltage signal terminal is smaller than a voltage of the signal of the data signal terminal, and a difference between the voltage of the signal of the reference voltage signal terminal and a voltage of the first electrode of the light emitting device is greater than a threshold voltage of the driving transistor when the light emitting device emits light.

9. A display apparatus, comprising the pixel circuit according to claim 1.

10. A driving method of the pixel circuit according to claim 1, comprising:

in a data input stage, loading a first level signal to the first scanning signal terminal, loading the first level signal to the second scanning signal terminal, loading a second level signal to the first control signal terminal, loading the second level signal to the light emitting control signal terminal, and loading a first potential signal to the second control signal terminal;

in a compensation stage, loading the second level signal to the first scanning signal terminal, loading the second level signal to the second scanning signal terminal, loading the second level signal to the first control signal terminal, loading the second level signal to the light emitting control signal terminal, and loading a second potential signal to the second control signal terminal; and in a light emitting stage, loading the second level signal to the first scanning signal terminal, loading the second level signal to the second scanning signal terminal, loading the first level signal to the first control signal terminal, loading the first level signal to the light emitting control signal terminal, and loading the second potential signal to the second control signal terminal.

11. The driving method according to claim 10, wherein the first level signal and the second level signal are opposite level signals.

* * * * *